US010053912B2

(12) United States Patent
Kieffer et al.

(10) Patent No.: US 10,053,912 B2
(45) Date of Patent: Aug. 21, 2018

(54) EXTENDABLE / RETRACTABLE LADDER

(71) Applicant: Core Distribution, Inc., Minneapolis, MN (US)

(72) Inventors: Mitchell I. Kieffer, Key Biscayne, FL (US); Allen A. Caldwell, Savage, MN (US); Nathan L. Schlueter, Bloomington, MN (US); Matthew J. Decker, St. Paul, MN (US)

(73) Assignee: Core Distribution, Inc., Minneapolis, MN (US)

( * ) Notice: Subject to any disclaimer, the term of this patent is extended or adjusted under 35 U.S.C. 154(b) by 0 days.

(21) Appl. No.: 15/712,717

(22) Filed: Sep. 22, 2017

(65) Prior Publication Data

US 2018/0010388 A1 Jan. 11, 2018

Related U.S. Application Data

(63) Continuation of application No. 13/533,430, filed on Jun. 26, 2012, which is a continuation of application (Continued)

(51) Int. Cl.

| | |
|---|---|
| ***E06C 1/12*** | (2006.01) |
| ***E06C 7/08*** | (2006.01) |
| *E06C 7/46* | (2006.01) |

(52) U.S. Cl.

CPC ..... *E06C 1/125* (2013.01); *E06C 7/081* (2013.01); *E06C 7/082* (2013.01); *E06C 7/086* (2013.01);

(Continued)

(58) Field of Classification Search

CPC ..... E06C 1/125; E06C 7/082; E06C 7/087

See application file for complete search history.

(56) References Cited

U.S. PATENT DOCUMENTS

| | | | |
|---|---|---|---|
| 872,165 | A | 11/1907 | Adler et al. |
| 1,045,957 | A | 12/1912 | Dicks |

(Continued)

FOREIGN PATENT DOCUMENTS

| | | |
|---|---|---|
| DE | 4408095 A1 | 9/1995 |
| DE | 1951689 | 8/1996 |

(Continued)

OTHER PUBLICATIONS

Extended European Search Report for Application No. 14153035.2, dated Oct. 11, 2016, 7 pages.

(Continued)

*Primary Examiner* — Colleen M Chavchavadze

(74) *Attorney, Agent, or Firm* — Fredrikson & Byron, P.A.

(57) ABSTRACT

An extendable/retractable ladder assembly includes a first stile and a second stile and a plurality of rungs extending therebetween. Each stile may comprise a plurality of columns disposed in a nested arrangement for relative axial movement in a telescopic fashion. A connector assembly connects the rungs to respective columns in the first and second stiles. The ladder has improved manufacturability since connector assemblies may be assembled before connecting the rungs to respective columns. The standing surface of the rungs may be angled such that it is rotated towards horizontal when the ladder assembly is leaned against a wall. A latch assembly may be used to selectively lock relative axial movement between adjacent columns. The latch assembly includes a locking pin assembly comprised of a central post and an outer metal sleeve. An air damper may also be used to control airflow through the columns.

10 Claims, 9 Drawing Sheets

Related U.S. Application Data

No. 12/196,556, filed on Aug. 22, 2008, now Pat. No. 8,225,906.

(52) U.S. Cl.
CPC ..... *E06C 7/087* (2013.01); *E06C 7/46* (2013.01); *Y10T 29/49826* (2015.01)

(56) References Cited

U.S. PATENT DOCUMENTS

| | | | |
|---|---|---|---|
| 1,712,942 | A | 5/1929 | Smith et al. |
| 2,194,856 | A | 3/1940 | Kostuk et al. |
| 2,827,216 | A | 3/1958 | Napolitano et al. |
| 2,993,561 | A | 7/1961 | Watson et al. |
| 3,033,309 | A | 5/1962 | Fugere et al. |
| 3,085,651 | A | 4/1963 | Rich et al. |
| 3,085,652 | A | 4/1963 | Rich et al. |
| 3,451,506 | A | 6/1969 | Neal |
| 3,653,463 | A | 4/1972 | Neal |
| 3,858,684 | A | 1/1975 | Goings |
| 4,002,223 | A | 1/1977 | Bernkrant et al. |
| 4,086,980 | A | 5/1978 | Shortes et al. |
| 4,100,448 | A | 7/1978 | Chipner et al. |
| D248,839 | S | 8/1978 | Turner |
| 4,119,177 | A | 10/1978 | Andersson |
| D254,630 | S | 4/1980 | Aberer et al. |
| 4,429,766 | A | 2/1984 | Alimbau Marques |
| 4,448,283 | A | 5/1984 | Marques |
| 4,457,391 | A | 7/1984 | Alimbau Marques et al. |
| 4,483,415 | A | 11/1984 | Disston et al. |
| 4,574,918 | A | 3/1986 | Marques et al. |
| 4,627,149 | A | 12/1986 | Colas |
| 4,926,967 | A | 5/1990 | Baker et al. |
| 4,967,484 | A | 11/1990 | Nosek |
| 4,989,692 | A | 2/1991 | Min et al. |
| 5,417,511 | A | 5/1995 | Warden |
| 5,492,430 | A | 2/1996 | Jones |
| 5,495,915 | A | 3/1996 | Weston et al. |
| 5,593,239 | A | 1/1997 | Sallee |
| 5,645,140 | A | 7/1997 | Mouneimneh |
| 5,738,186 | A | 4/1998 | Jones |
| 5,743,355 | A | 4/1998 | McDonnell et al. |
| 5,924,658 | A | 7/1999 | Shiery et al. |
| 6,006,399 | A | 12/1999 | Massaro |
| 6,006,952 | A | 12/1999 | Lucas |
| 6,361,002 | B1 | 3/2002 | Cheng |
| D462,453 | S | 9/2002 | Johansson |
| 6,461,074 | B2 | 10/2002 | Taylor |
| 6,520,291 | B2 | 2/2003 | Andrey |
| 6,708,800 | B2 | 3/2004 | Kieffer et al. |
| 7,048,094 | B2 | 5/2006 | Kieffer et al. |
| 8,056,679 | B2 | 11/2011 | Hong |
| 2003/0029676 | A1 | 2/2003 | Gibson et al. |
| 2004/0020718 | A1 | 2/2004 | Kieffer et al. |
| 2004/0195043 | A1 | 10/2004 | Johansson |
| 2006/0283664 | A1 | 12/2006 | Yao |
| 2007/0209875 | A1 | 9/2007 | Chen |
| 2008/0000723 | A1 | 1/2008 | Kieffer et al. |
| 2008/0023269 | A1 | 1/2008 | Parker |
| 2009/0065304 | A1 | 3/2009 | Jian |

FOREIGN PATENT DOCUMENTS

| | | | |
|---|---|---|---|
| DE | 19530452 | A1 | 2/1997 |
| EP | 1402143 | A1 | 3/2004 |
| EP | 1516999 | A2 | 3/2005 |
| EP | 1728966 | A2 | 12/2006 |
| EP | 1816312 | A2 | 8/2007 |
| WO | 1991015651 | | 10/1991 |
| WO | 1993002271 | | 2/1993 |
| WO | 02101189 | A1 | 12/2002 |
| WO | 2006128845 | A1 | 12/2006 |
| WO | 2008064532 | A1 | 6/2008 |

OTHER PUBLICATIONS

Brochure, "The World's Broadest Line of Telescopic Ladders", pp. 2-3, www.telesteps.com. 2009.

PCT/US2009/053850, International Search Report and Written Opinion, dated Oct. 6, 2009.

EXTENDABLE / RETRACTABLE LADDER

This application is a continuation of U.S. application Ser. No. 13/533,430, filed Jun. 26, 2012 which is a continuation of U.S. application Ser. No. 12/196,556, filed Aug. 22, 2008, which issued as U.S. Pat. No. 8,225,906. The referenced application is hereby incorporated by referenced in its entirety.

TECHNICAL FIELD

The present disclosure pertains to an extendable/retractable ladder, and, more particularly, to an extendable/retractable ladder with improved manufacturability.

BACKGROUND

Extendable/retractable ladders typically include rungs supported between stiles formed from telescoping columns, which can be expanded to separate apart from one another, for extension of the ladder, or collapsed together for retraction of the ladder. These ladders often include mechanisms, which hold the columns relative to one another in an extended state; these mechanisms can be manually released to allow the columns to collapse together for retraction of the ladder. There is a need for extendable/retractable ladder features, pertaining to these mechanism, which provide for improved ladder construction and assembly as well as for improved handling of the assembled ladder.

SUMMARY

Embodiments of the present disclosure pertain to an extendable/retractable ladder, and, more particularly, to an extendable/retractable ladder with improved manufacturability. In certain embodiments, the extendable/retractable ladder assembly includes a first stile, a second stile, a plurality of rungs extending between the first and second stiles and a plurality of connector assemblies. The rungs are disposed at an angle between 5 and 45 degrees relative to a plane normal to the axis of the stiles, whereby the standing surface is rotated towards horizontal when the ladder assembly is leaned against a wall. The ladder assembly includes a plurality of connector assemblies coupling the rungs to the stiles, where a rung portion of the connector assemblies establishes the angle of rungs.

Certain embodiments comprise an extendable/retractable ladder assembly that includes first and second stiles, a plurality of rungs extending between the stiles. The first stile includes first, second, and third columns disposed in a nested arrangement for relative axial movement in a telescopic fashion. The ladder assembly also includes a latch assembly for selectively locking relative axial movement between the first and second columns where the latch assembly includes a spring-biased locking pin assembly extendable into apertures in the first and second columns to lock them and retractable from at least the second column to unlock them. The locking pin assembly includes a central post extending through an outer tube and terminating at a distal end just past the end of the outer tube. The outer tube provides support for locking the columns and the distal end of the central post provides a non-galling surface for slidable engagement with the second or third columns.

Certain embodiments include a method of assembling an extendable/retractable ladder that include providing a rung and a column, where the column is disposable in other columns in a nested arrangement for relative axial movement in a telescopic fashion. The method includes assembling a bracket and a locking pin assembly to form a connector assembly where the connector assembly includes a collar portion and a rung portion and the locking assembly includes a release button that is actuatable to retract the locking pin assembly further into the interior of the connector assembly. The method includes fixing the connector assembly to the rung by inserting the rung portion into the rung after forming the connector assembly. The method also includes fixing the connector assembly to the column by fastening the collar portion around the entire column after forming the connector assembly.

BRIEF DESCRIPTION OF THE DRAWINGS

The following drawings are illustrative of particular embodiments and therefore do not limit the scope of the invention. The drawings are not necessarily to scale (unless so stated) and are intended for use in conjunction with the explanations in the following detailed description. Embodiments will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides practical illustrations for implementing exemplary embodiments.

Figure 1A:
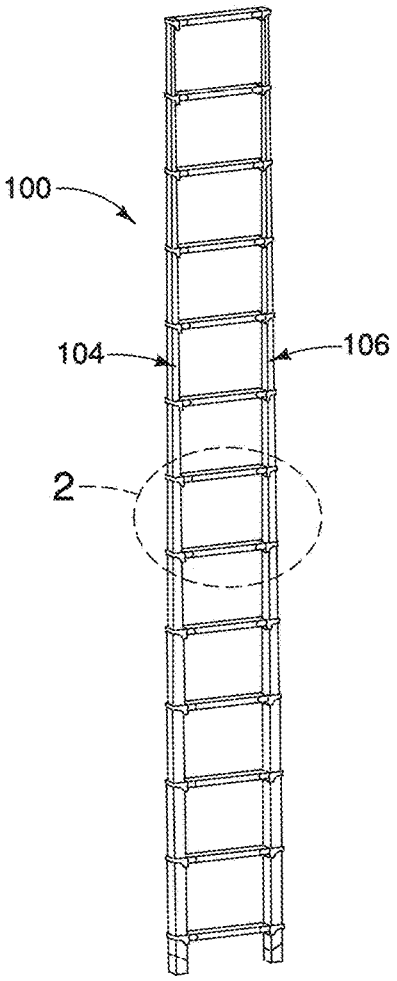
FIG. 1A is a front perspective view of a ladder according to some embodiments.
Figure 1B:
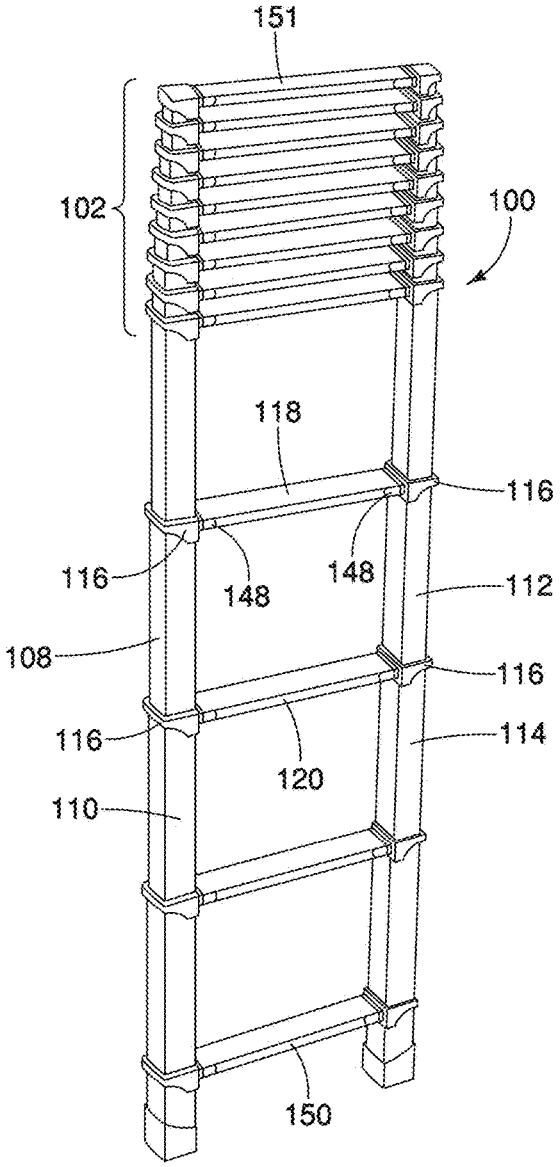
FIG. 1B is a front perspective view of a partially extended and partially retracted ladder according to some embodiments.

Embodiments relate to an extendable/retractable ladder, and, more particularly, to an extendable/retractable ladder with improved manufacturability. With reference to the drawing figures, FIG. 1A is a front perspective view of a ladder 100 according to some embodiments. FIG. 1B is a front perspective view of a ladder 100 with an extended section and a retracted section 102 according to some embodiments. Ladder 100 includes two opposing stiles, a left-hand stile 104 and a right-hand stile 106, each formed by a plurality of telescoping columns. The plurality of columns are disposed in a nested arrangement for relative axial movement in a telescopic fashion along an axis running along the elongated height of the columns. Labeled columns 108, 110, shown in FIG. 1B, make up a portion of the left-hand stile 104. Labeled columns 112, 114, shown in FIG. 1B, make up a portion of the right-hand stile 106. According to the illustrated embodiment each opposing column of each stile includes a rung extending therebetween, wherein each rung is coupled on either end to an opposing column by a connector assembly 116. Rung 118 is shown coupled to column 108 by a connector assembly 116. Rung 118 is coupled to column 112 by connector assembly 116. Similarly, rung 120 is coupled to columns 110 and 114 by connector assemblies 116 and 116, respectively. In some embodiments, the columns are formed of aluminum. Additionally, in certain embodiments, the rungs are formed of aluminum. Other materials are contemplated within the scope of the present disclosure.

Figure 2:
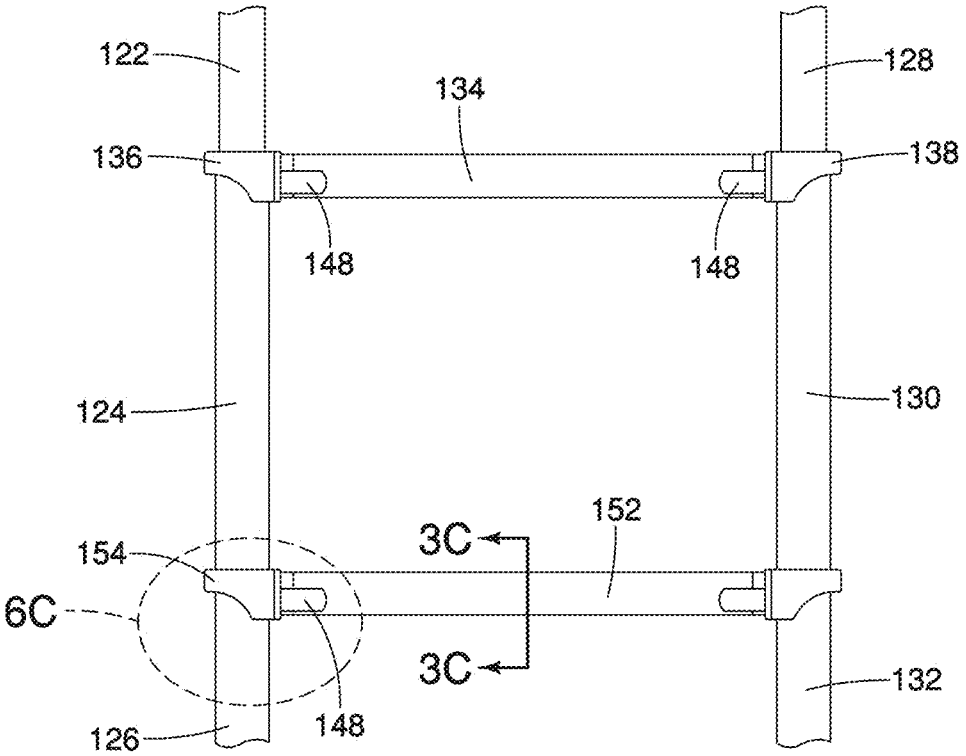
FIG. 2 is a front plan view showing additional details of the portion of the ladder taken along portion II of FIG. 1A.
Figure 3A:
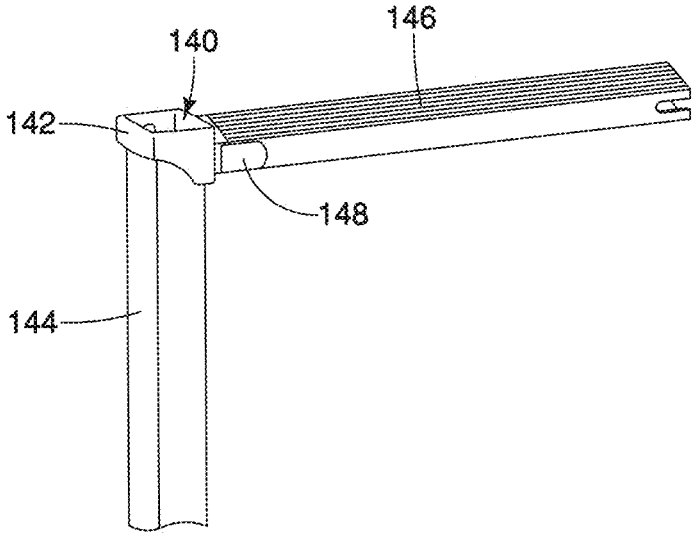
FIG. 3A is a detailed perspective view of a portion of the ladder shown in FIG. 2.
Figure 3B:
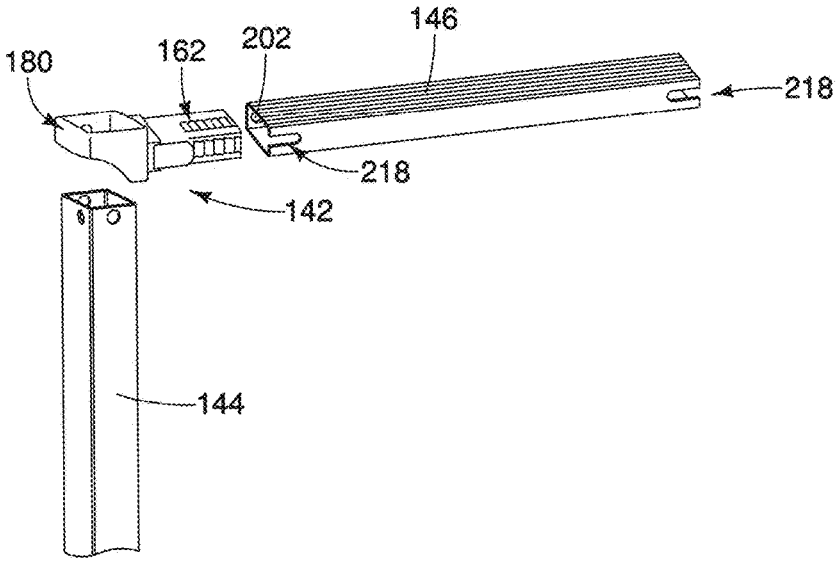
FIG. 3B is an exploded perspective view of the portion of the ladder shown in FIG. 3A.

FIG. 2 is a front plan view showing additional details of the portion of the ladder 100 taken along portion 2 of FIG. 1A, according to some embodiments. FIG. 2 illustrates, for a portion of the left-hand stile, column 122 nested within column 124, which is, in turn, nested within column 126. Similarly, FIG. 2 illustrates, for a portion of right-hand stile, column 128, nested within column 130, which is, in turn, nested within column 132. FIG. 2 further illustrates, for instance, rung 134 connecting column 124 to column 130. That is, rung 134 is connected to column 124 via connector assembly 136, which is further described below. Similarly, rung 134 also connects to column 130 via connector assembly 138. FIG. 3A is a detailed perspective view of a portion of the ladder shown in FIG. 2, according to some embodiments, with the upper column removed on the portion of the left-hand stile shown and the entire right-hand stile removed. FIG. 3A shows an opening 140 in connector assembly 142 for receiving the upper column. FIG. 3B is an exploded perspective view of the portion of the ladder shown in FIG. 3A. FIG. 3B shows connector assembly 142 exploded from its connection to column 144 and rung 146.

FIGS. 2 and 3A also illustrate release buttons 148. As will be described in detail below, each connector assembly includes a latch assembly for selectively locking relative axial movement between two adjacent columns. Each release button 148 is manually actuatable to unlock the selectively locked relative axial movement between two adjacent columns. In the embodiment shown in FIG. 2, the release buttons 148 may be slid inwardly along the front surface of rung 134, preferably by the thumbs of the user, to unlock their respective latch assemblies. Thus, when release buttons 148 on both the right and left hand sides of rung 134 are actuated, adjacent columns 122, 128 are permitted to move axially. Gravity will cause such columns 122, 128, and their rung (not shown) to collapse downward to assume a position similar to rungs shown in the collapsed portion 102 of the ladder 100 shown in FIG. 1A.

Figure 3C:
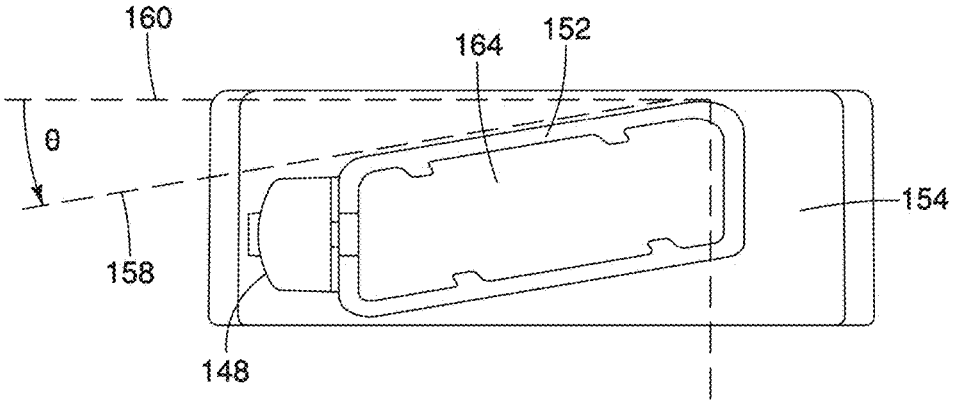
FIG. 3C is a cross-sectional view of the ladder taken along line 3C-3C in FIG. 2.

FIG. 3C is a cross-sectional view of a portion of the ladder 100 taken along line 3C-3C in FIG. 2, but it is representative of cross sections of all of the rungs except for the bottom-most rung 150 and the upper-most rung 151, which may not contain latch assemblies. FIG. 3C shows rung 152 and connector 154, including release button 148. Columns 124 and 126 have been removed from view in FIG. 3C for simplicity sake. Axis 156 is also shown. As noted above, the plurality of columns are disposed in a nested arrangement for relative axial movement in a telescopic fashion along axis 156 running along the elongated height of the columns. Rung 152 is mounted at an angle relative the ladder 100. That is, the top surface of rung 152 defines a generally planar surface, represented by dotted line 158. This surface 158 may be considered a standing surface since it is intended to be stepped on by a user of the ladder. A plane normal to axis 156 is represented by dotted line 160 in FIG. 3C. As shown, the generally planar standing surface 158 and a plane 160 normal to the axis 156 of the plurality of columns forms an angle θ. In some embodiments, the angle θ is between 5 and 45 degrees. In other embodiments, the angle θ is between 5 and 25 degrees. In the illustrated embodiment, the angle θ is about 15 degrees. Accordingly, as the ladder 100 is leaned against a wall in normal operation, the standing surface 158 rotates toward the horizontal. Of course, depending on the angle that at which ladder 100 is positioned, the standing surface 158 may be angled short of or past the horizontal. If angle θ is zero degrees, as with conventional telescoping ladders, then the standing surface will always be angled many degrees past the horizontal. Certain embodiments provide an angled standing surface as described above to keep the standing surface closer to horizontal during normal use of ladder 100. As shown in FIG. 3B, a rung portion 162 of the connector assembly 142 is inserted in rung 146. Pin capture 164 of the connector assembly 154, which is described further below, is visible in FIG. 3C and sits at the same angle θ. Accordingly, rung portion 162 is canted at angle θ and establishes the angle of standing surface 158.

Figure 4A:
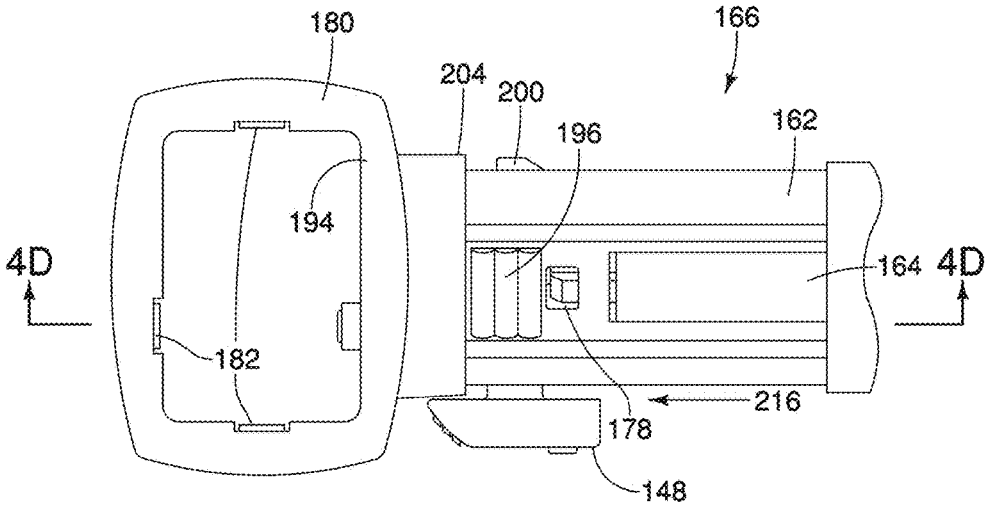
FIG. 4A is a top view of a connector assembly, according to some embodiments.
Figure 4B:
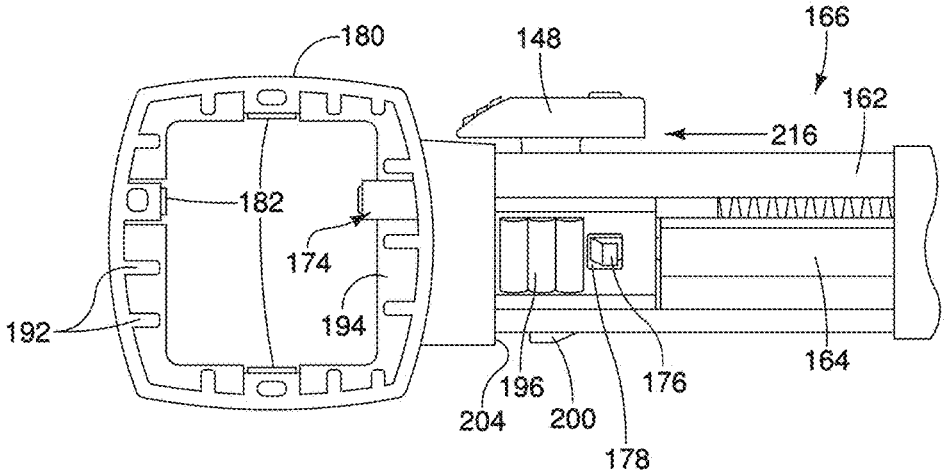
FIG. 4B is a bottom view of the connector assembly shown in FIG. 4A.
Figure 4C:
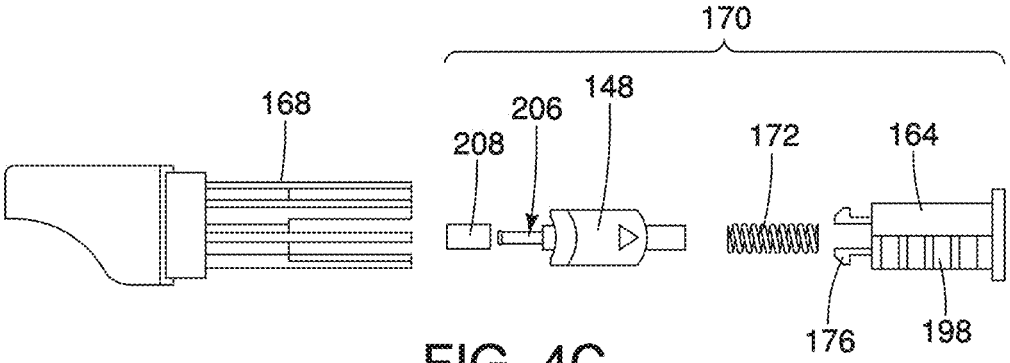
FIG. 4C is an exploded plan view of the connector assembly shown in FIG. 4A.
Figure 4D:
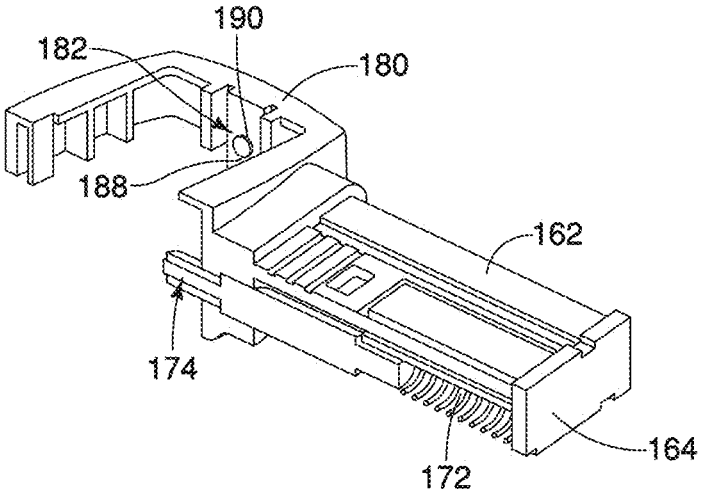
FIG. 4D is a cross-section of a perspective view of the connector assembly shown in FIG. 4A taken along line 4D-4D in FIG. 4A.

FIGS. 4A-4D provide further details regarding the construction of connector assembly 166, according to some embodiments. Connector assembly 166 may be representative of all connector assemblies in ladder 100, although connector assemblies on the right stile may be a mirror image of connector assembly 166. FIG. 4A is a top view of a connector assembly 166, according to some embodiments. FIG. 4B is a bottom view of the connector assembly 166 shown in FIG. 4A. FIG. 4C is an exploded plan view of the connector assembly 166 shown in FIG. 4A. FIG. 4D is a cross-section of a perspective view of the connector assembly 166 shown in FIG. 4A taken along line 4D-4D in FIG. 4A. As shown by these figures, the connector assembly 166 is formed of a bracket 168 and a latch assembly 170. The latch assembly 170 is formed of a pin capture 164, a spring 172, and a locking pin assembly 174, which is shown in greater detail in FIGS. 5A and 5B. To assemble the connector assembly 166, the spring 172 and the locking pin assembly are placed between the bracket 168 and the pin capture 164. The spring 172 and a back end of the locking pin assembly 174 are captured and held by a receptacle formed by the pin capture 164. Pin capture 164 contains a pair of opposing flexible tabs 176 that deflect toward one another when pin capture 164 is inserted within bracket 168 to assemble the connector assembly 166. According to the illustrated embodiment, each tab 176 includes a projection having a tapered leading edge which allows insertion of the flexible tabs into keeper holes 178 of bracket 168 for assembly. Each projection also includes an upright trailing edge to prevent pulling of tabs or pin capture 164 out of keeper holes 178, once assembled. During assembly, the projecting end of locking pin assembly is inserted through an opening in the bracket 168. The spring 172 biases the locking pin assembly 174 in the extended position shown in FIGS. 4A, 4B, and 4D. A user may actuate release button 148 in a direction that compresses spring 172 in order to retract the locking pin assembly 174 further into the interior of the connector assembly 166. In certain embodiments, bracket 168 and pin capture 164 are formed of a molded thermoplastic, for example a glass filled nylon such as PA6-GF30% or ABS. Spring 172 may be formed of metal, such as stainless steel.

The connector assembly forms a collar portion 180 and a rung portion 162. The collar portion 180 connects around an end of a column and the rung portion 162 is inserted into the open end of a rung. The collar portion has an interior surface with one or more tabs 182 that are inserted into corresponding openings 184 (FIG. 6A) located proximate the end of column 186. The tabs help fasten the collar portion 180 around the entire column 186. Referencing FIG. 6D, each tab 182 has a tapered leading edge 188 to facilitate insertion of the tab 182 into its corresponding opening in the column. The tapered leading edge helps push the tab past the end of the column. Each tab also has an upright trailing edge 190 to help prevent removal of the tab 182 from the opening 184 in the column and fix the connector assembly around the entire column. The interior surface of the collar portion 180 also includes a series of ribs 192. In some embodiments, the ribs are distributed around the entire interior surface of the collar portion 180. The ribs 192 create a friction fit with the end of the column when the collar portion 180 is pushed around the end of the column 186. The friction fit helps fasten the collar portion 180 around the entire end of the column. As will be described further below, the interior surface of the column also includes a lip 194 or flange that extends slightly inward of the ribs. The lip 194 provides a support surface against which the top edge of a column abuts, thereby preventing the collar portion 180 from descending down the column.

As noted above, the rung portion 162 of a connector assembly 166 is inserted into the open end of a rung. Similar to the collar portion 180, the rung portion 162 may include ribs and a tab to fasten the rung portion 162 to a rung. That is, the outer surface of rung portion 162 includes a first series of ribs 196, formed on bracket 168, that are friction fitted with the interior of the rung when the rung portion is inserted into the rung. The outer surface of the rung portion 162 also includes a second series of ribs 198, formed on pin capture 164, that are friction fitted with the interior of the rung when the rung portion is inserted into the rung. The use of additional or fewer sets of ribs is contemplated within the scope of the present disclosure. The outer surface of rung portion 162 also includes a projecting tab 200, formed on bracket 168, that is inserted into a corresponding opening 202 (FIG. 3B) on the back face of a rung. As shown in FIG. 3B, rung 146 in the illustrated embodiment contains an opening 202 proximate both the right and left open ends of rung 146. The tab 200 helps fasten the rung portion 162 to the rung 146. The tab 200 has a tapered leading edge to facilitate insertion of the tab into its corresponding opening in the rung. The tapered leading edge helps when pushing the tab into the open end of the rung. The tab also has an upright trailing edge to help prevent removal of the tab 200 from the opening 202 in the rung and fix the connector assembly to a rung. Similar to the use of a lip on the collar portion, the outer surface of the rung portion also includes a shoulder 204. The shoulder 204 provides a surface against which the end of a rung abuts, thereby preventing the rung portion 162 from further insertion into the rung.

Figure 5A:
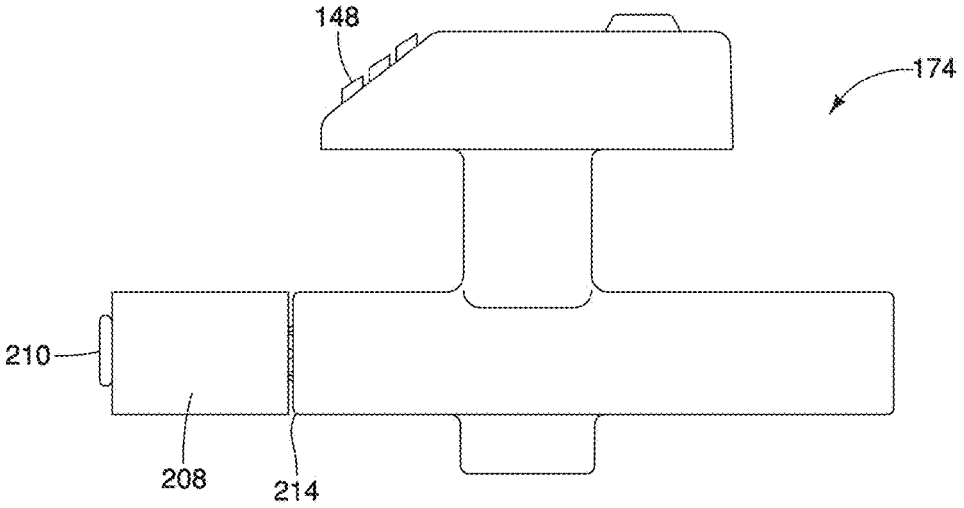
FIG. 5A is a plan view of a button and locking pin assembly, according to some embodiments.
Figure 5B:
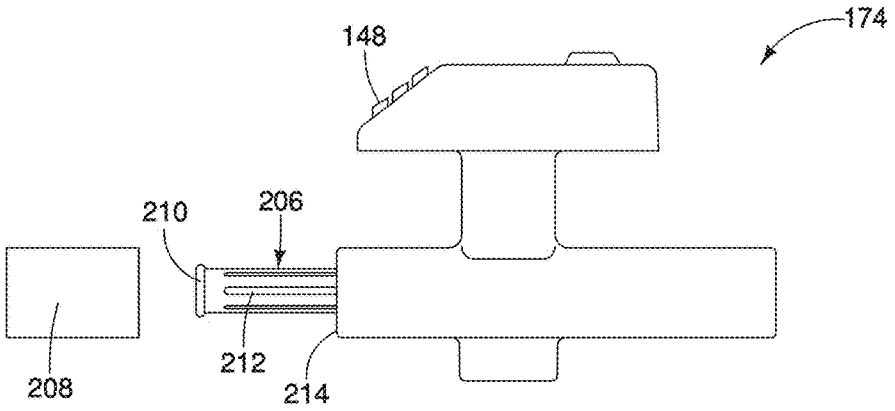
FIG. 5B is an exploded plan view of the button and locking pin assembly of FIG. 5A.

FIG. 5A is a plan view of a locking pin assembly 174, according to some embodiments. FIG. 5B is an exploded plan view of the button and locking pin assembly of FIG. 5A. The locking pin assembly provides several functions, including selectively locking relative axial movement between adjacent columns of the plurality of columns that form a stile. The locking pin assembly includes a central post 206 and an outer tube 208. Outer tube 208 may be cylindrical, as illustrated, or other appropriate shapes, including elliptical or rectangular. The central post 206 extends through the outer tube 208 and terminates in a flange 210. The flange 210 retains the outer tube 208 on the central post 206 to maintain the assembly. In certain embodiments, the flange 210 is flexible enough to permit the outer cylinder to be press fit over the flange and around the central post, but rigid enough to restrict the outer tube 208 from being pulled off of the central post 206. In the illustrated embodiment, the central post 206 includes one or more ribs 212 oriented radially relative to the post. The outer tube 208 forms a friction fit with the ribs 212 when placed around the central post 206 in order to help retain retain the outer cylinder on the central post. The central post also includes a shoulder 214 against which the outer tube 208 abuts to stop the outer cylinder from extending further along the central post 206. The outer cylinder may be formed of metal, such as stainless steel, and it provides strength to the locking pin assembly so that it may lock the relative axial movement between adjacent columns. The central post may be formed of plastic. In certain embodiments, the central post may be molded to the outer cylinder. For instance, the central post may be injection molded within the pre-existing outer tube 208.

The locking pin assembly 174 includes a release button 148 formed integrally with a central post 206. Forming the release button 148 integrally with the central post reduces the number of parts necessary for assembly of the ladder 100 and provides more consistent quality of the resultant ladder structure. As noted above, the release button may be slid in a direction along the front surface of the ladder to unlock the selectively locked relative axial movement between two adjacent columns. The release button 148, as shown in FIGS. 4A and 4B, is offset a short distance from the outer surface of bracket 168. This offset 216 provides clearance for sliding the rung between the bracket 168 and the release button 148.

Referring back to FIGS. 3A and 3B, rung 146 in the illustrated embodiment contains a relief slot 218 proximate both the right and left open ends of rung 146. The relief slots 218 are located on the front surface of the rung 146 and extend centrally from the open ends of the rung and provide a gap that permits actuation of the release buttons 148 to lock and unlock the latch assembly. The front surface of the rung may be generally parallel to the axis of the plurality of columns (generally perpendicular to the plane normal to the axis of the plurality of columns). The relief slots 218 also permit insertion of the rung portion 162 into the open end of the rung. That is, since relief slots 218 are open on their outside ends, the rung portion, including the release button, may be inserted into the rung. If the relief slots were closed (i.e., forming merely an aperture on the rung face), the release button could not be included on the rung portion when it is inserted into the open end of the rung.

Figure 6A:
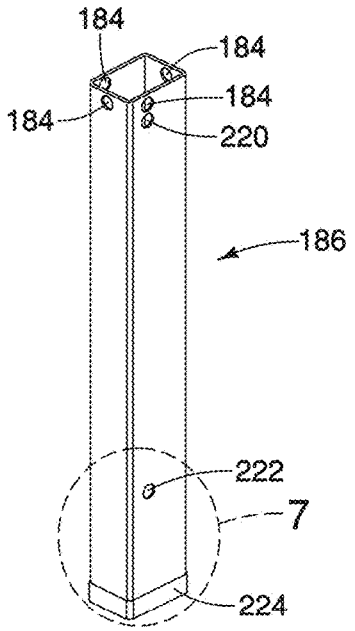
FIG. 6A is a perspective view of a ladder column and damper assembly, according to some embodiments.
Figure 6B:
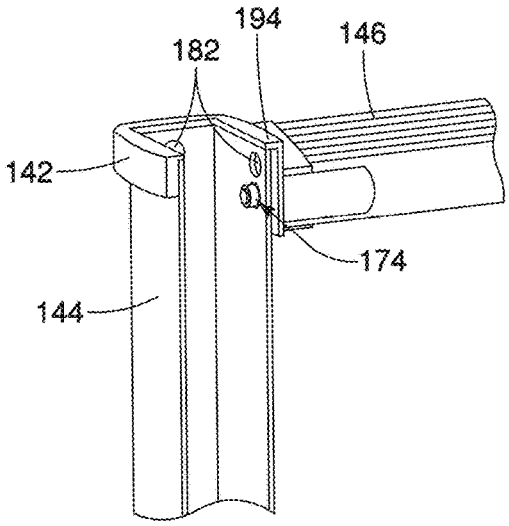
FIG. 6B is a detailed perspective view, including a cut-away section, of the portion of the ladder shown in FIG. 3A, according to some embodiments.
Figure 6C:
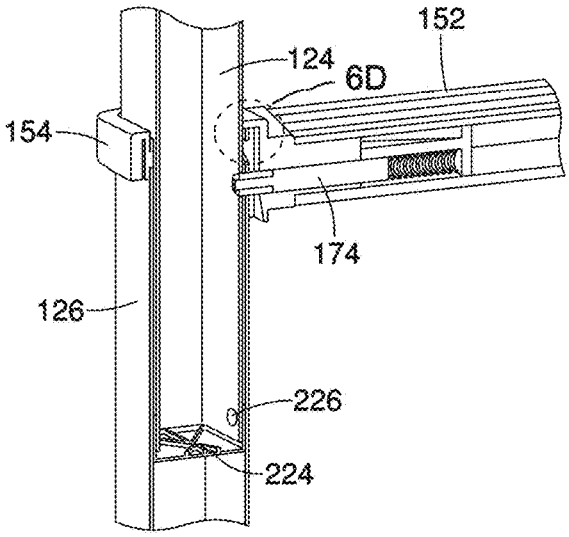
FIG. 6C is a detailed perspective view, including a cut-away section, of the portion of the ladder indicated at 6C in FIG. 3A, according to some embodiments.
Figure 6D:
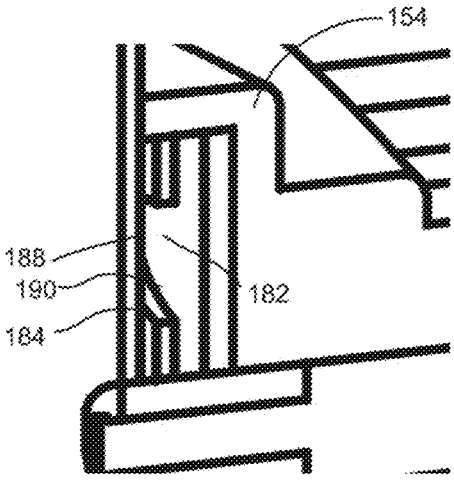
FIG. 6D is a detailed perspective view, including a cut-away section, of the portion of the ladder indicated at 6D in FIG. 6C, according to some embodiments.

FIG. 6A is a perspective view of a ladder column and damper assembly, according to some embodiments. FIG. 6B is a detailed perspective view, including a cut-away section, of the portion of the ladder shown in FIG. 3A, according to some embodiments. FIG. 6B shows first column 144 connected to rung 146 via connector assembly 142. FIG. 6C is a detailed perspective view, including a cut-away section, of the portion of the ladder indicated at 6C in FIG. 2, according to some embodiments. FIG. 6C again shows a first column 126 connected to rung 152 via connector assembly 154. Additionally, FIG. 6C shows second column 124, which is the column adjacent to the first column 126. Second column 124 nests in first column 126, where relative axial movement between column 124 and column 126 is locked by locking pin assembly 174.

Drawing FIG. 6A shows the one or more openings 184 proximate the end of a column 186 for receiving tabs 182 from the interior surface of a collar portion of a connector assembly (FIGS. 4A, 4B, 4D). As illustrated, column 186 contains one opening 184 on each of the four faces of the column. Additional or fewer openings 184 are contemplated within the scope of the present disclosure. For instance, one opening on just one set of opposing sides of the column 186 may instead be used. Or two openings on three sides of the column 186 may instead be employed. Corresponding tabs 182 on the interior surface of the collar portion are received within the openings 184 during assembly. FIG. 6B also shows, for instance, how lip 194 confronts and bears against the top edge of column 144, thereby preventing the collar portion from descending further downward along the height of the column 144.

Referring in particular to FIG. 6A, column 186 contains aperture 220 proximate its upper end and aperture 222 towards its lower end. Apertures 220 and 222 receive the central post 206 and outer tube 208 of locking pin assemblies 174. For instance, as shown in FIG. 6B, locking pin assembly 174 is shown in its extended position such that locking pin assembly 174 extends through aperture 220. In FIG. 6C, when adjacent column 126 and 124 are shown, locking pin assembly 174 is shown extending through aperture 220 in first column 126 and aperture 222 in second column 124 in order to lock the relative axial movement between first column 126 and its adjacent column, second column 124. Outer tube 208 of locking pin assembly provides sufficient strength and resilience to maintain the lock even under load when a user steps on the rung connected on the upper end of second column 124. In some embodiments, outer tube 208 is formed of steel or aluminum. As noted above, flange 210 helps retain outer tube 208 on central post 206. Additionally, flange 210 provides a non-galling surface for sliding engagement with the second column 124. That is, when the locking pin assembly is retracted via the release button 148, locking pin assembly retracts inward, and, at least retracts from its extension through aperture 222 in the second column 124. Retracting of the locking pin assembly 174 permits second column 124 to descend downward in a further nested position within first column 126. As second column 124 descends, the spring bias of spring 172 may push locking pin back against the outside surface of second column 124. Flange 210 will come into contact with the outside surface of second column 124 as it descends. In some embodiments, flange 210 is formed of a non-scratch or non-galling material, such as plastic, that will not scratch or gall the outside surface of second column 124 as it descends further into first column 126 (or, conversely, extends from such first column 126). In addition, although not shown in FIG. 6C, it is clear from other drawing figures of ladder 100 that one or more columns may be nested in second column 124. That is, unless second column 124 represents the top-most rung, a third column will be nested in second column 124. When such a third column descends into second column 124 (or extends from it), the outside surface of such third column may slide against flange 210 of locking pin assembly 174 locking first column and second column 124 together. Again, flange 210 may provide a non-scratching or galling surface for sliding engagement with such a third column. In some embodiments, locking pin assembly 174 may also retract from its extension through aperture 220 in first column 126 when the release button 148 is actuated.

Figure 7A:
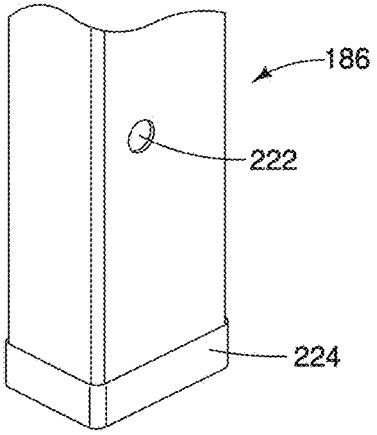
FIG. 7A is a front perspective showing additional details of the ladder column and damper assembly taken along portion VII in FIG. 6A, according to some embodiments.
Figure 7B:
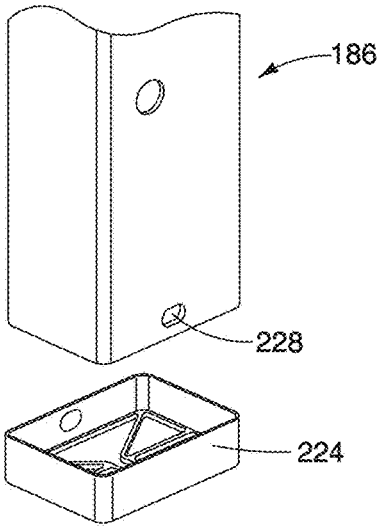
FIG. 7B is an exploded perspective view of the ladder column and air damper assembly shown in FIG. 7A.
Figure 7C:
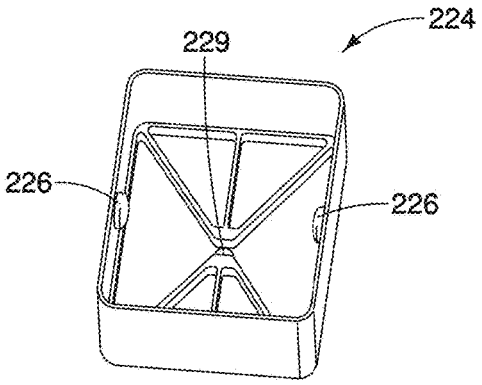
FIG. 7C is an upper perspective view of the air damper shown in FIG. 7B.

FIG. 7A is a front perspective showing additional details of the ladder column and damper assembly taken along portion 7 in FIG. 6A, according to some embodiments. FIG. 7B is an exploded perspective view of the ladder column and air damper assembly shown in FIG. 7A. FIG. 7C is an upper perspective view of the air damper shown in FIG. 7B. In the illustrated embodiment, air damper 224 caps the bottom end of column 186 to restrict air flow through the column 186. Air damper 224 and column 186 are representative of the other air dampers and columns, although the columns on the right stile may be a mirror image of column 186. Air damper 224 has two pins 226 on its inner surface that are received in corresponding openings 228 on the bottom end of column 186 to retain the air damper on the column 186. In addition the thickness of air damper 224 is such that its outer surface, as shown for instance in FIG. 6C, contacts the internal surface of the adjacent, larger column, first column 126 in FIG. 6C. Accordingly, air damper 224 provides stability to the lower end of second column 124. The inner surface of first column 126 (the adjacent larger column) supports the lower end of second column 124 via mutual contact with air damper 224. Air damper 224 may also have an aperture 229 through which limited air may flow into the bottom of the column to which air damper is attached. Such aperture may be used to control the rate of descent of one column into its lower columns.

Figure 8A:
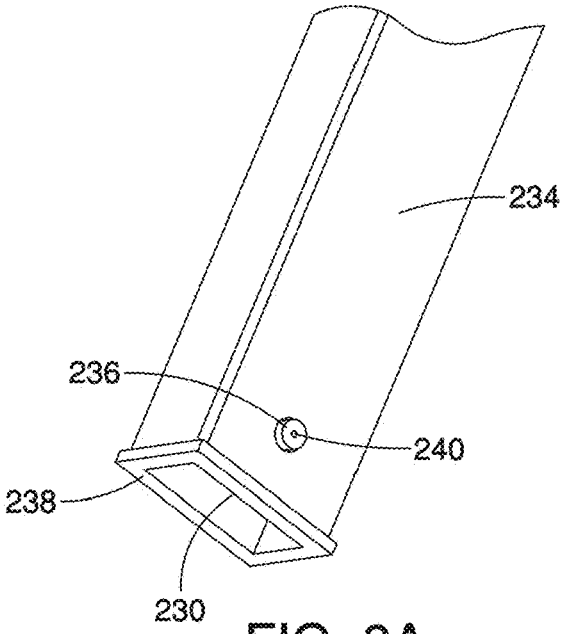
FIG. 8A is a side perspective view of a ladder column and air damper assembly, according to some alternate embodiments.
Figure 8B:
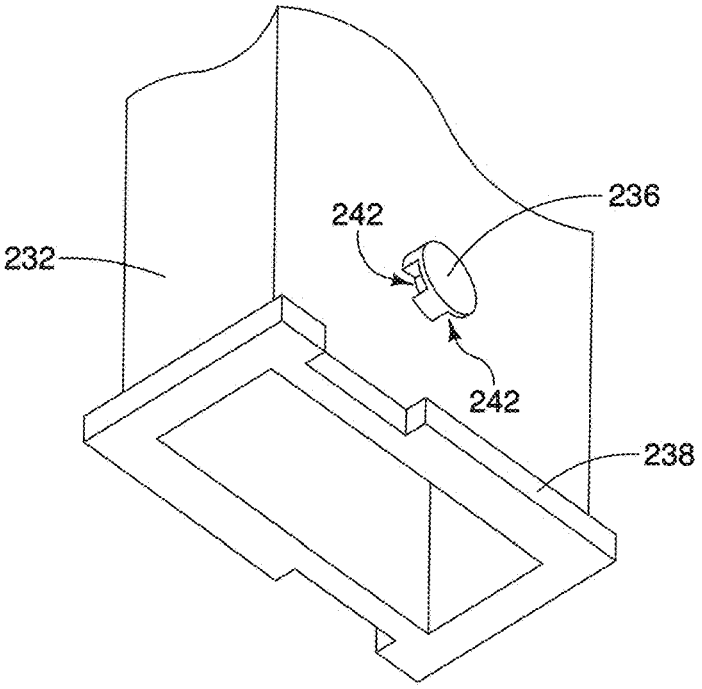
FIG. 8B is a lower perspective view of an air damper, according to some alternate embodiments.

FIG. 8A is a side perspective view of a ladder column and air damper assembly, according to some alternate embodiments. FIG. 8B is a lower perspective view of an air damper 232, according to some alternate embodiments. Air dampers 230 and 232 are inserted into the bottom end of column 234 to restrict air flow through the column. Air dampers 230, 232 have two pins 236 that extend from its outer surface and that are received in corresponding holes proximate the bottom end of column 234 in order to retain the air dampers 230, 232 in column 234. In addition, a portion of air dampers 230, 232 does not extend into column 234. This portion may form a flange 238 with an external guiding surface for contacting the inner surface of the adjacent larger column, within which column 234 is nested. Therefore, similar to air damper 224, air damper 230 in FIG. 8A and air damper 232 in FIG. 8B provide stability to and restrict air flow through the lower end of their respective columns and between adjacent columns. Air damper 230 in FIG. 8A also provides an orifice 240 running centrally through one or both of pins 236. Orifice 240, similar to orifice 229 in air damper 224, permits limited air flow. However, instead of directing such air flow through the column to which the air damper is attached, air damper 230 instead allows air flowing into its bottom to exit towards the adjacent larger column. In air damper 230 in FIG. 8A, orifice 240 direct air flow directly towards the adjacent larger column. In air damper 232 in FIG. 8B, aperture 242 instead directs air flow along the space between the adjacent columns. That is, the exit apertures 242 are pointed such that air flows along the length of the columns. It is believed that air flow paths from the bottom of a column to a location between the columns provide for good control of the descent of one column into another. The flange on air damper 232 may also include a one or more recesses to help the bottom of a column extend past the extended locking pin assembly locking the next two larger adjacent columns.

The invention claimed is:

1. An extendable/retractable ladder assembly, comprising:

a first stile comprising a plurality of columns disposed in a nested arrangement for relative axial movement in a telescopic fashion along an axis of the plurality of columns;

a second stile; a plurality of rungs extending between the first stile and the second stile; and a connector assembly coupled to a first column in the plurality of columns proximate an end thereof and coupled to a rung of the plurality of rungs, the connector assembly having a collar portion and a rung portion, the rung portion being coupled to the rung of the plurality of rungs, an interior of the collar portion includes a plurality of tabs which are received within corresponding openings of the column at the end thereof to fasten the collar portion around the entire column, each tab having a tapered leading edge to facilitate insertion into the corresponding openings in the column and having an upright trailing edge to help prevent removal of the tab from the opening in the column and fix the connector assembly to around the entire column.

2. The ladder assembly of claim 1, wherein the connector assembly has a latch assembly for selectively locking relative axial movement between two adjacent columns of the plurality of columns.

3. The ladder assembly of claim 1, wherein each rung having an upper surface defining a generally planar standing surface, the planar standing surface and a plane normal to the axis of the plurality of columns forming an angle between about 5 and 45 degrees, whereby the standing surface is rotated towards horizontal when the ladder assembly is leaned against a wall; and, the rung portion having an upper surface generally parallel with the generally planar standing surface such that the rung portion establishes the angle of the planar standing surface of the respective rung.

4. The ladder assembly of claim 3, wherein the angle formed is between about 5 degrees and 20 degrees.

5. The ladder assembly of claim 3, wherein each connector assembly has a latch assembly for selectively locking relative axial movement between two adjacent columns of the plurality of columns.

6. The ladder assembly of claim 4, wherein the each rung has a front surface defining a generally planar surface, the latch assembly including a release button slidable along the front surface to unlock the selectively locked relative axial movement between two adjacent columns of the plurality of columns, the front surface being generally perpendicular to the plane normal to the axis of the plurality of columns.

7. The ladder assembly of claim 1, further comprising an air damper inserted partially into and plugging the second column proximate a proximal end thereof, the air damper including a flange with an external guiding surface for contacting the internal surface of the first column, the air damper including one or more pins which are received within openings of a second column for fixing the air damper to the second column, the one or more pins including an aperture that provides an airflow path through the air damper and through the openings of the second column, whereby the air damper generally restricts airflow through the second column to the airflow path through the aperture.

8. The ladder assembly of claim 7, wherein the airflow path through the aperture is directed towards the first column.

9. The ladder assembly of claim 8, wherein the airflow path through the aperture is directed along the outer surface of second column, parallel to the inner surface of the first column.

10. The ladder assembly of claim 1, wherein the plurality of tabs comprising a first tab and a second tab, and the interior of the collar portion comprising a first surface and a second surface, the first tab being provided on the first surface and the second tab being provided on the second surface.

* * * * *